United States Patent [19]

Rotter

[11] 4,306,506

[45] Dec. 22, 1981

[54] GASIFICATION APPARATUS

[75] Inventor: Franz Rotter, Portland, Oreg.

[73] Assignee: Energy Recovery Research Group, Inc., Portland, Oreg.

[21] Appl. No.: 155,508

[22] Filed: Jun. 2, 1980

[51] Int. Cl.[3] ..... F23G 5/00

[52] U.S. Cl. ..... 110/229; 48/62 R; 48/76; 48/111; 110/255; 110/256

[58] Field of Search ..... 110/229, 251, 255, 346, 110/227, 230, 256; 48/76, 62 R, 111

[56] References Cited

U.S. PATENT DOCUMENTS

| | | | |
|---|---|---|---|
| 833,673 | 10/1906 | Capitaine | 48/64 |
| 1,821,263 | 9/1931 | Imbert | 48/76 |
| 4,142,867 | 3/1979 | Kiener | 48/111 X |

FOREIGN PATENT DOCUMENTS

| | | | |
|---|---|---|---|
| 880836 | 1/1943 | France | 48/76 |
| 905858 | 7/1944 | France | 48/62 R |

*Primary Examiner*—Edward G. Favors
*Attorney, Agent, or Firm*—Philip D. Junkins

[57] ABSTRACT

Apparatus for the conversion of solid fuels and solid organic waste materials by high temperature gasification into gaseous fuel called "producer gas." The apparatus comprises a stacked two-section gasifier defining sequentially descending drying, distillation, oxidation and reduction reaction zones through which a column of the solid fuel descends during its conversion to the gaseous fuel. The lower reactor section is of double-shell construction and defines the lower oxidation and reduction reaction zones. Means are provided for drawing air into the oxidation zone for burning reaction with carbonized fuel passing therethrough and for thereafter drawing reaction gases downwardly through the lower reduction zone of the gasifier and then through the annular space defined by the double-shell structure of the lower section in indirect counter-current heat exchange relationship with the fuel column portion in the oxidation and reduction zones. The inner shell element of the lower section is arranged in hanging manner within its associated outer shell element to allow expansion of the double-shell structure under the high temperature conditions experienced by the gasifier without harmful stress build-up in the apparatus. The inner shell element supports within its lower portion two stacked funnel-shaped transition pieces which form a series of throat-like constrictions for supporting the fuel column in the gasifier and which cause localized increase in the velocity of the gases passing downwardly therethrough and leaving the reduction zone of the reactor.

7 Claims, 1 Drawing Figure

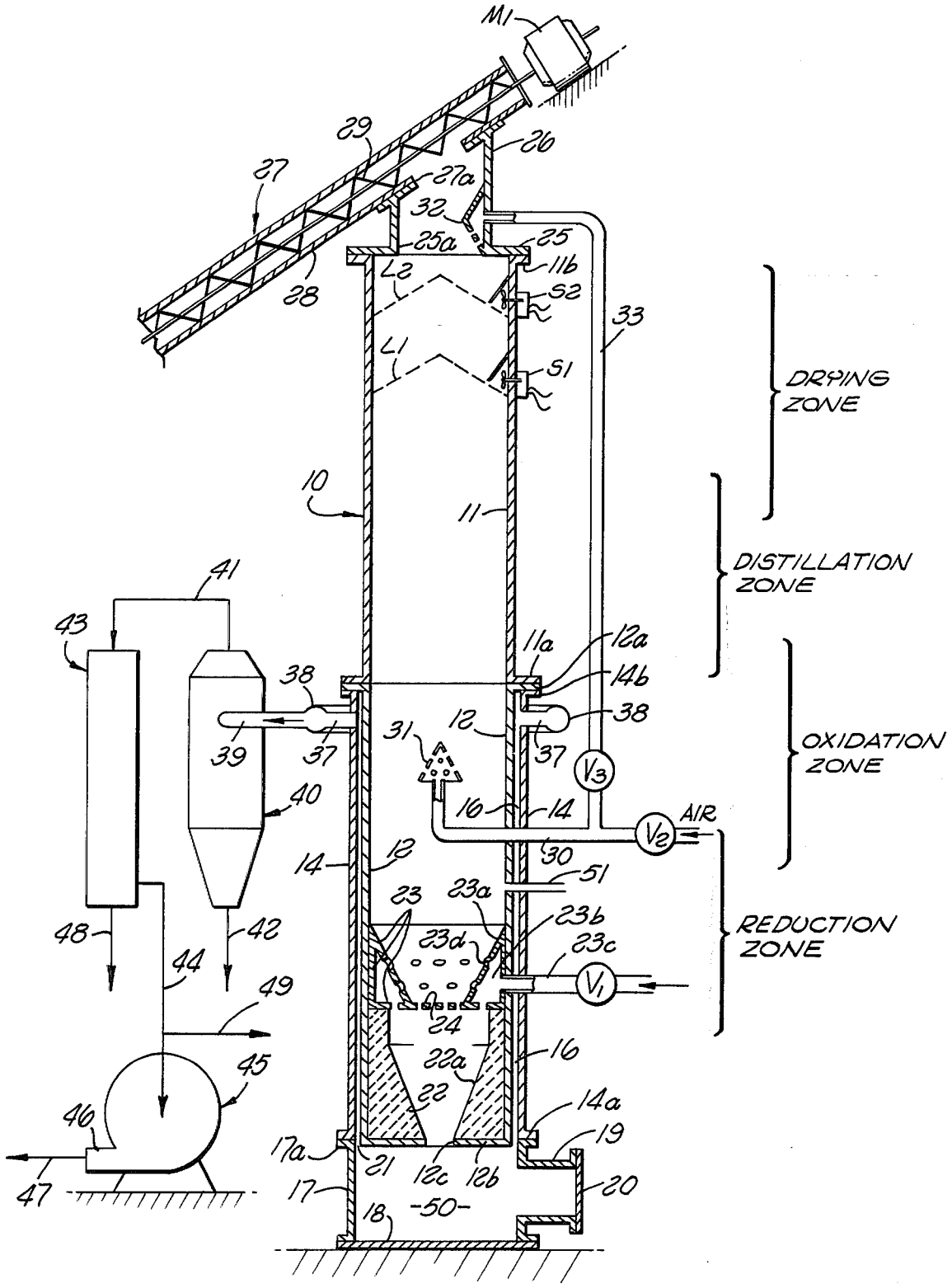
M1
29
26
27
27a
32
25a
25
11b
L2
S2
28
33
L1
S1
DRYING ZONE
10
11
DISTILLATION ZONE
41
43
11a
12a
14b
38
12
38
31
39
37
37
V3
OXIDATION ZONE
40
16
14
AIR
V2
14
12
30
51
23
23a
23b
REDUCTION ZONE
48
42
23d
23c
44
V1
49
24
45
22a
16
22
14a
46
19
17a
21
12c
12b
20
47
17
-50-
18

GASIFICATION APPARATUS

BACKGROUND OF THE INVENTION

This invention relates to apparatus for the conversion of solid organic materials, having a fuel value, by high temperature gasification into a clean-burning and uniform gaseous fuel called "producer gas." More particularly, the invention relates to a gasifier in which peat, lignite, coal, anthracite, coke and other solid organic materials (including solid organic waste materials such as wood chips, sawdust, pine cones, other forest wastes, walnut and almond shells, fruit pits, corn cobs and other agricultural wastes, and like materials) used as solid fuels are transformed into gaseous fuels and in the process of such transformation carry the largest possible amount of energy from the solid to the gaseous state while keeping the resulting gaseous fuels clean and free from undesireable constituents of the solid fuels.

Solid fuels of the type mentioned above, in addition to containing the impurities of ash and water, consist of so-called fixed carbon and volatile matter. The objective of gasification is to obtain substantially complete transformation of the gasifiable constituents of the solid fuel into fuel gases leaving only ash and inert materials as a solid residue of the conversion process. Gasification occurs when air is led across or drawn through glowing hot gasification material, the stream of air being either dry or containing steam. Usually gasification occurs under the influence of steam since the air flow always contains some moisture and the solid fuels normally utilized in gasification systems contain moisture. Further, such solid fuels usually contain some hydrogen which reacts with oxygen creating steam.

Gasification systems and their associated gasifier apparatus have generally fallen into one of three classifications as follows: (1) updraft gasification; (2) downdraft gasification; and (3) crossdraft gasification. Under each classification a column of the solid fuel to be gasified is developed in a reactor or stack and air is passed through the column. As the fuel gasification proceeds the column gradually moves downwardly within the reactor or stack into a lower hearth zone. The air stream can be led in the same direction as the direction of fuel movement (downdraft gasification) or led in a direction opposite to the direction of movement of the descending fuel column (updraft gasification). If the air stream traverses the descending fuel column crossdraft gasification is promoted. Each method allows the fuel to gradually enter the hearth zone where highest temperature conditions subsist.

In the basic form of an updraft gasification system the fuel column rests on a grate through which a stream of air and steam passes. Above the grate a hearth zone develops with a reduction zone, a distillation zone and a drying zone lying sequentially above the hearth zone within the fuel column. The product gas is drawn off above the fuel column after having transferred some of its heat to the fuel in the distillation and drying zones in the upper part of the column. Only tar free fuels such as charcoal or anthracite are suitable for updraft gasification systems. If the fuel contains tar, as do wood, peat, lignite, etc., the tar is gasified and carried off with the producer gas generated through the gasification system. A tar separator is then required to prevent the tars from fouling or otherwise adversely affecting downstream equipment.

In downdraft gasifiers the air stream enters the system in the area of the hearth zone (usually through nozzles arranged circumferentially or through a central nozzle) and draws all of the gaseous fuel components down into the hearth zone, there to enter into the gasification reactions. Tars and moisture are exposed at high temperature to the carbon in the hearth zone and undergo partial combustion and partial dissociation so that the final producer gas leaving the system is tar free. Downdraft gasification systems have developed a characteristic funnel shaped constriction of the hearth at or just below the entry of the air stream. The hearth constriction or throat causes a localized increase in the air flow velocity which in turn causes localized high temperature conditions for conversion of the tars into their gaseous components. Downdraft gasifier operation is generally unsuitable for fuels with high ash content because the high temperatures generated in the throat section of the hearth cause sintering of the ash into a slag which is difficult to remove and causes functional problems in the system.

In crossdraft gasification air is introduced through a small diameter high velocity nozzle and is projected across the fuel column to achieve a hearth zone of small volume but of very high temperature. Tar dissociation is limited because of the small hearth zone that is developed and therefore low tar fuels are preferred for crossdraft gasification.

OBJECTS OF THE INVENTION

The present invention relates to high temperature gasification apparatus involving the basic characteristics of downdraft gasification systems. Accordingly, an object of the present invention is to provide novel gasifier apparatus for converting solid organic materials (having a fuel value) by high temperature downdraft gasification into a clean-burning and uniform gaseous fuel called "producer gas," the gasifier being of double-shell construction over the area defining the oxidation and reduction zones, with the inner shell being of suspended design to allow expansion of the gasifier shell elements without stress build-up in the apparatus.

Another object of the present invention is to provide gasifier apparatus for high temperature gasification of solid organic materials (having a fuel value) which is of double-shell construction in its lower section defining oxidation and reduction zones with the inner shell of the lower gasifier section being of suspended design to allow expansion of the gasifier shell elements without stress build-up and with the inner and outer shells of the lower gasifier section defining an annular space for the passage therethrough of "producer gas" (generated within the gasifier) in indirect heat exchange relationship with materials undergoing gasification.

A still further object of the invention is to provide gasifier apparatus of double-shell configuration in its lower section defining oxidation and reduction zones in which downdraft gasification (conducted at relatively high gasification temperature) may be carried on without stress build-up in the apparatus because of heat expansion of the gasifier shell elements, and in which the "producer gas" (generated within the gasifier) exits the gasifier through a sequence of funnel shaped constricting hearths and then moves in counter-current indirect heat exchange relationship with materials undergoing gasification within the lower gasifier section.

Still other objects and advantages of the present invention will become apparent after reading the accompanying description of a selected illustrative embodiment of the invention with reference to the attached drawing.

SUMMARY OF THE INVENTION

The foregoing objects of the present invention are achieved in gasification apparatus of double-shell configuration in its lower section defining oxidation and reduction zones in which high temperature downdraft gasification is carried out by pulling reaction air (or an air-stream mixture) into the apparatus at the oxidation reaction zone developed within the apparatus and thereafter leading and pulling the reacting and reacted gases generated within the apparatus downwardly through a materials reduction reaction zone with the material undergoing gasification and thence through a sequence of funnel shaped constricting hearths at relative high velocity to a gas-velocity reduction zone. The double-shell apparatus then directs the reacted producer gas in counter-current indirect heat exchange flow relationship with the materials undergoing oxidation and reduction by passage of such gas within the annular space defined by the lower double-shell elements. The producer gas being pulled through the apparatus leaves the lower double-shell annulus proximate the upper boundary of the oxidation zone, is subjected first to particulate matter disentrainment and thereafter to further cleaning and cooling, and is then pulled through a suction-blower or other device creating the pulling action on all air and gaseous mixtures entering and being generated within the gasifier and passing through the system. The double-shell construction of the gasifier apparatus in its lower section comprises suspension or hanging of the lower inner shell element within the lower outer shell element to allow expansion of the gasifier double-shell section without harmful stress build-up in the apparatus during its high temperature gasification operation.

DESCRIPTION OF THE DRAWING

The invention will be more clearly understood by reference to the following detailed description of an exemplary embodiment thereof in conjunction with the accompanying drawing in which the FIGURE is a side sectional elevation of gasifier apparatus for converting solid organic materials (having a fuel value) by high temperature conversion into clean-burning and uniform producer gas.

DETAILED DESCRIPTION OF THE INVENTION

Referring now in detail to a preferred embodiment illustrating the present invention, numeral 10 denotes generally the stationary gasifier reactor in the drawing. The reactor 10 is of double-shell construction in its lower section. The upper tubular section 11 and a lower tubular section 12 cooperate to form the supporting stack structure for developing and confining a downwardly moving column of feed material to be gasified. An outer tubular section 14 surrounds and is spaced from the lower tubular section 12 forming therebetween annular space 16. Appropriate flanges are provided at the ends of tubular sections 11, 12 and 14 of the gasifier 10 for sealably connecting and arranging same in accordance with the present invention. The lower double-shell structure of the gasifier is connected to, and supported by, a tubular base section 17 which includes a bottom wall 18 and a side access port 19 with removable cover 20.

In structural arrangement the outer-lower tubular section 14 of the gasifier is affixed through lower flange **14*a* to the upper flange 17*a* of the base section 17. The upper flange 14*b* of lower section 14 supports and is affixed to upper flange 12*a* of inner-lower tubular section 12. Thus, the inner section 12 hangs freely within outer section 14 and the two sections together form annular space 16. The inner-lower tubular section 12 of the gasifier contains the lower portion of the downwardly moving column of materials undergoing gasification, such column portion comprising the highest temperature reaction zones of oxidation and reduction. By provision of the suspended or hanging arrangement for the inner-lower tubular section 12, full expansion of such section is permitted under the high heat conditions experienced by the section without any build-up of stress in the outer (and supporting) tubular section 14. The annular space 16 defined by tubular sections 12 and 14 is open at the bottom so that the gases generated within gasifier 10, and moving downwardly therein, may enter such space through annular orifice 21 and move upwardly between the double-shell sections 12 and 14. The upper portion of the gasifier 10 comprises single shell section 11 supported on and connected to, flanges 14*b* and 12*a* of the lower sections of the gasifier. Thus, lower flange 11*a* of tubular section 11 is affixed to flanges 14*b* and 12*a***.

The lower end of inner tubular section 12 is closed by end wall **12*b* except for a central opening 12*c*. End wall 12*b* supports internally a funnel-shaped transition piece 22 which in turn supports at its upper periphery an upper funnel-shaped transition piece 23 which includes a grate portion 24. The downwardly and inwardly tapering surface 22*a* of transition piece 22 cooperates with opening 12*c* of end wall 12*b* to form a throat-like constriction which causes a localized increase in the velocity of the gases passing therethrough. Likewise, the downwardly and inwardly tapering surface 23*a* of the upper transition piece 23 cooperates with openings in its grate portion 24 to cause localized increase in the velocity of the gases passing through and leaving the reduction zone. The upper transition piece 23 (as shown) may be hollow and thereby define an annular space 23*b*. The space 23*b* may be provided cooling air through pipe 23*c* which includes a one-way, flapper-type valve $V_1$, such air being dispersed from space 23*b* to the reduction and oxidation zones as process air through openings 23*d* in surface 23*a* of the transition piece 23**.

The upper end of the gasifier 10 is closed by plate 25 which has a central opening **25*a* through which the solid feed materials to be gasified are fed. Supported by the plate 25 is a materials inlet pipe 26 which in turn supports and is in communication with an auger-type materials conveying device 27 of well-known design. The conveying device 27 is comprised of a housing 28, feed auger 29 and drive motor $M_1$. The conveying device 27 communicates with gasifier inlet pipe 26 through opening 27*a*. Solid material level sensing devices $S_1$ and $S_2$, of common tupe, are located along the inside wall of inner tubular section 11 near its upper end. These sensing devices control motor $M_1$ and thus the auger-type materials conveying device 27 in known manner and sequence whereby the solid materials level within the gasifier 10** ranges between angle-of-repose level $L_1$ (lowest level) and angle-of-repose level $L_2$ (highest level).

Air (or an air-stream mixture) enters the gasifier 10 within the oxidation (or hearth) zone (developed within the upper portion of lower tubular section 12) through inlet pipe 30 which includes a one-way, flapper-type valve $V_2$. The air (or air-steam) stream is deflected downwardly and outwardly throughout the materials column within the oxidation zone by deflector cone 31. Air and/or steam that may accumulate within the gasifier space above the materials column may be removed via collector baffle arrangement 32 which connects with down pipe 33 and which may join air inlet pipe 30 to return the accumulated air and/or steam to the reactor system. A one-way, flapper-type valve $V_3$ may be included in pipe 33.

The producer gas generated during operation of the gasifier 10 (as described hereinafter) travels downwardly and leaves the lower reduction zone of the gasifier through upper transition piece 23 and lower transition piece 22 and then flows upwardly through the annular space 16 formed between lower section 12 and outer tubular section 14. Such gas leaves space 16 through a multiplicity of spaced, radially-projecting pipes 37 which lead the gas into an annular header 38. From header 38 the producer gas is led through pipe 39 into a hot gas, cyclone-type cleaner 40 of well-known construction and operation. The clean hot producer gas stream is thereafter led through pipe 41 to a gas cooler-cleaner 43 of well-known construction and operation. Finally, the clean, relatively cool producer gas stream is led from the cooler-cleaner 43 through pipe 44 to a suction-blower 45 from which it is discharged through blower outlet 46 to line 47 for use as: a clean-burning gaseous fuel which can be directly substituted for natural gas, propane or fuel oil in boilers, dryers, kilns, furnaces, etc.; or a fuel for diesel or gasoline engines. The suction-blower 45 pulls all gases and gas mixtures through the entire system and the components of apparatus comprising the system as will be described hereinafter.

Ash particles, which remain as a solid residual of the solid fuel after the latters final high temperature reduction in the lower reaction zone of the gasifier, leave the reduction zone with the producer gas through opening **12*c* in end wall 12*b* and, for the most part, are disentrained in velocity reduction zone 50 defined by gasifier base section 17. Within this zone disentrained ash collects and is periodically removed through port 19. Any entrained ash particles carried by the producer gas stream through annular space 16, pipes 37, header 38 and pipe 39 into the cyclone-type gas cleaner 40 are separated from the gas stream therein and drop to the bottom of the cleaner and exit same through pipe 42. Water and tar removed from the producer gas as it passes through cooler-cleaner 43 drop to the bottom of the cooler-cleaner and exit same through pipe 48**.

One or more sight holes or sight tubes 51 may be provided through the lower gasifier sections 12 and 14 wherein the high temperature oxidation and reduction zones are developed so that visual inspection can be made of such zones during operation of the gasifier and through which optical pyrometer readings may be taken to measure the temperature profile of these zones. Other temperature measuring devices (not shown) such as thermocouples, etc., may be located within the gasifier at critical points so that temperatures may be periodically or continuously observed, monitored and recorded for gasifier process control purposes.

A portion of the product producer gas being pulled through line 44 by suction-blower 45 may be drawn off through line 49 and recycled to gasifier 10 through line **23*c* entering the lower portion of the reduction zone through transition piece 23 or through line 30 entering the oxidation zone. Thus, such recycle gas portion may be further heat treated in the reduction and oxidation zones of the gasifier whereby the carbon dioxide component (non-combustible) of such gas portion is dissociated into carbon monoxide (combustible) thereby upgrading the net Btu content of the producer gas ultimately produced by the system and utilized as a clean-burning uniform gaseous fuel. Since the negative pressure applied to line 44 by suction-blower 45 is greater than the negative pressure applied by such suction-blower to inlet lines 23*c* and 30, a secondary suction-blower (not shown in the drawing) is necessary to draw recycle gases from line 44 through line 49** and pump same into the gasifier.

The materials utilized for construction of the stacked two-section gasifier reactor of the present invention must be carefully selected so as to withstand the extremely high temperatures developed during solid fuel gasification, particularly in the lower reactor section defining the oxidation and reduction zones. Thus, the inner-lower tubular section 12 of the gasifier, transition piece 23 and grate 24 must be constructed of high temperature nickel/steel alloy materials. Further, the funnel-shaped transition piece 22 which supports transition piece 23 and is supported within the lower portion of tubular section 12 is preferably formed of castable alumina ceramic material capable of withstanding temperatures of at least 1,600° C.

In further illustration of the gasifier apparatus of the present invention, a general description is now provided of the numerous reactions occurring between the solid fuels entering and passing through the gasifier and the air or air-steam stream introduced to the oxidation zone developed within the gasifier to generate the desired producer gas product fuel. Solid fuels of the types indicated hereinbefore are maintained within the gasifier 10 as a continuous downwardly moving column or stack extending from the top of the gasifier (below fuel inlet pipe 26) to grate 24. In the upper section of the gasifier a top fuel drying zone is developed by heat rising within the fuel column from the lower zones within the gasifier. For fuels such as wood wastes (having moisture levels of as high as 30% by weight) the drying reaction results in the production steam which may be removed from the top of the drying zone via pipe 33 and transported to pipe 30 leading into the oxidation zone. Temperatures at the top of the drying zone may range from 100°-150° C. or more.

Still within the upper section of the gasifier, but below the drying zone, there is developed a fuel distillation or degasification zone within which low temperature carbonization occurs. Where wood wastes comprise the solid fuel, tars and oils are driven from the fuel within the distillation zone and the fuel is converted to charcoal. The heat for distillation obtains by radiation from the lower fuel oxidation (burning) zone within the lower section of the gasifier. The vapors of distillation and steam are drawn downwardly within the downwardly moving fuel stack by suction-blower 45 which pulls all vapors and gases within the system to it.

In the lower double-shell section of the gasifier upper oxidation or burning and lower reduction zones are developed within the fuel column. Reaction air (or an air-steam mixture) is drawn into the fuel oxidation zone through line 30 by suction-blower 45. Within the oxidation or burning zone the fuel (if wood waste is now in the form of charcoal) is converted to hot gas (carbon dioxide—$CO_2$), and glowing carbon. Steam in the carbonization gases, and as may be introduced to the oxidation zone from outside of the gasifier, is partially dissociated into hydrogen and oxygen. Tar and oil components are dissociated. The dissociated oxygen burns with the charcoal and the hydrogen remains in the gases being drawn downwardly. The burning reaction between the oxygen in the air and from steam dissociation and the carbon in the fuel supplies sufficient heat for a second reaction to occur in the lowest portion of the stack or fuel column (passing through the reduction zone). This second reaction produces carbon monoxide (CO), a major combustible component of producer gas. Thus, the principal reactions that occur in the oxidation and reduction zones are:

$$C+O_2 \rightarrow CO_2$$

$$C+\tfrac{1}{2}O_2 \rightarrow CO$$

$$C+H_2O \rightarrow CO+H_2$$

$$CO+H_2O \rightarrow CO_2+H_2$$

$$CO_2+C \rightarrow 2CO$$

The tars and oils, principally produced within the distillation zone, are vaporized and move downwardly with the gases, and are decomposed within the oxidation and reduction zones by the hot glowing carbon into gases which include hydrogen and a small quantity of methane. Because of the high temperature operation possible with the gasifier design of this invention, the glowing carbon in the lower reduction reaction zone is substantially all converted to gaseous fuel form with only negligible quantities of unreacted carbon and the fuel ash (less than about 2% total) remaining as residue passing with the reaction gases through the grate 24 and funnel-shaped transition piece 23 and through lower transition piece 22 into gas velocity reducing zone 50 wherein residual carbon and ash particles are, for the most part, disentrained. Thus, zone 50 acts as an ash pit or ash collection zone for the gasifier 10.

Having passed through the grate and funnel-shaped transition pieces and through the ash disentrainment zone, the hot producer gas (500°-1,000° C.) moves upwardly through annular space 16 surrounding the reduction and oxidation zones and exits such space through pipes 37 for passage through header 38 and pipe 39 to a hot gas cyclone cleaner wherein fine carbon dust and ash particles are removed. The hot, clean producer gas leaving the cyclone (300°-500° C.) is thence drawn by suction-blower 45 through gas cleaner-cooler 43.

Within the gasifier the drying zone temperatures range from 150° to 200° C., distillation zone temperatures range from 300° to 600° C. and the oxidation or burning zone temperatures are maintained at least above 700°-900° C. In the reduction zone temperatures of 1,000°-1,200° C. or more may be experienced. The producer gas, formed from solid fuels of the type mentioned, is basically comprised of combustible and non-combustible gaseous components as follows with representative percentages (by volume) for these components indicated for several solid fuels:

| Producer Gas Component | Wood (15% Moisture) | Peat |
|---|---|---|
| Combustible Components | | |
| Carbon Monoxide (CO) | 23% | 19% |
| Hydrogen ($H_2$) | 18 | 11 |
| Methane ($CH_4$) | 1 | 1 |
| Non-Combustible Components | | |
| Carbon Dioxide ($CO_2$) | 13 | 14 |
| Nitrogen ($N_2$) | 45 | 55 |
| | 100% | 100% |

With a portion of the producer gas recycled to the gasifier, as described above, the percentages carbon monoxide in the product gas may be increased by 3-5% with a corresponding decrease in the percentages of carbon dioxide of 2-4%.

Producer gas obtained through operation of the apparatus of this invention, utilizing solid fuels such as peat, lignite coal, anthracite, coke and other solid organic materials (including solid organic waste materials such as wood chips, sawdust, pine cones, other forest wastes, walnut and almond shells, fruit pits, corn cobs and other agricultural wastes, and like materials) may have heating values of 125-200 Btu/ft.$^3$. By recycling a portion of the producer gas the net product gas may have heating values of 150-250 Btu/ft.$^3$.

There has thus been described apparatus in which it is feasible to gasify economically solid fuels, including a wide variety of organic waste materials, to form a clean-burning and uniform gaseous fuel (of low but effective heating value). It is obvious that one skilled in the art may make modifications in the details of construction of the apparatus described without departing from the spirit of the invention which is set out in varying scope in the appended claims.

What is claimed is:

1. Apparatus for effecting the high temperature gasification of solid organic feed materials having a fuel value into clean-burning and uniform gaseous fuel comprising:

(a) a gasification reactor vessel having an upper tubular section, a lower double-shell section including an inner tubular shell element and an outer tubular shell element, said inner and outer shell elements of said lower section being affixed to one another at their upper peripheries with said inner shell element hanging freely within said outer shell element, a solid material inlet at the upper end of said upper section and a gas outlet at the lower end of said lower section, and two funnel-shaped transition pieces located in stacked relationship within the lower portion of the inner shell element of the lower reactor section providing a series of throat-like constrictions in said section leading to the gas outlet therein, said reactor vessel sections defining a sequence of reaction zones from the material inlet to the gas outlet including drying, distillation, oxidation and reduction zones and confining a centrally disposed downwardly moving column of said solid feed materials within said zones, and said lower double-shell section defining with its respective shell elements an annular shell space therebetween;

(b) means for charging solid organic feed materials through said material inlet to continuously supply a downwardly moving column of said materials in said reactor vessel;

(c) gas-feed means for admitting an oxygen-rich gas into said reactor vessel proximate the oxidation zone thereof so as to promote and sustain combustion of the column of organic materials passing therethrough;

(d) means connecting the gas outlet at the lower end of said lower reaction section with the lower end of the annular shell space of said section; and (e) gas suction means in communication with the upper end of the annular shell space of the lower reactor section for sequentially drawing oxygen-rich gas into the reaction vessel through the gas-feed means, drawing reacting gases and vapors downwardly through the zones of the reactor vessel, and drawing gaseous fuel produced within said vessel outwardly through the gas outlet and thence upwardly through the annular shell space of the lower reactor section in indirect countercurrent heat exchange relationship with the materials column portion in the reduction and oxidation zones within said vessel.

2. Apparatus as defined in claim 1 in which the upper funnel-shaped transition piece is provided with an internal annular channel which is in communication with gas-feed means for admitting oxygen-rich gas into said channel and the funnel wall of said transition piece is in supporting contact with the lower end of the downwardly moving column of solid organic feed materials within the gasification reactor vessel and is provided with a multiplicity of openings for the passage of oxygen-rich gas from said channel to said materials.

3. Apparatus as defined in claim 1 in which the upper funnel-shaped transition piece carries with it across its throat-like constriction a grate which cooperates with the funnel wall of said transition piece in supporting the downwardly moving column of solid organic material within the gasification reactor vessel.

4. Apparatus as defined in claim 1 in which means are provided to return a portion of the gaseous fuel produced within the gasification reactor vessel, after its has left the annular shell space of the lower reactor section, to the reduction zone within said section for high temperature dissociation therein to upgrade the fuel value of the gaseous fuel produced by said apparatus.

5. Apparatus as defined in claim 4 in which the means for returning the portion of gaseous fuel to the reduction zone of the gasification reactor vessel includes a suction-blower.

6. Apparatus as defined in claim 2 in which means are provided to return a portion of the gaseous fuel produced within the gasification reactor vessel, after it has left the annular shell space of the lower reactor section, to the internal annular channel of the upper funnel-shaped transition piece for passage to the reduction zone within said vessel for high temperature dissociation therein to upgrade the fuel value of the gaseous fuel produced by said apparatus.

7. Apparatus as defined in claim 6 in which the means for returning the portion of gaseous fuel to the reduction zone of the gasification reactor vessel includes a suction-blower.

* * * * *